US005124717A

United States Patent [19]

Campanelli et al.

[11] Patent Number: 5,124,717

[45] Date of Patent: Jun. 23, 1992

[54] INK JET PRINTHEAD HAVING INTEGRAL FILTER

[75] Inventors: Michael R. Campanelli; William G. Hawkins, both of Webster; Donald J. Drake, Rochester; James F. O'Neill, Penfield, all of N.Y.

[73] Assignee: Xerox Corporation, Stamford, Conn.

[21] Appl. No.: 624,390

[22] Filed: Dec. 6, 1990

[51] Int. Cl.[5] ..... B41J 2/05

[52] U.S. Cl. ..... 346/1.1; 346/140 R; 156/644

[58] Field of Search ..... 346/1.1, 140 R; 156/644

[56] References Cited

U.S. PATENT DOCUMENTS

| | | | |
|---|---|---|---|
| 4,417,946 | 11/1983 | Bohlen et al. | 156/643 |
| 4,419,182 | 12/1983 | Westerberg et al. | 156/644 |
| 4,561,789 | 12/1985 | Saito | 400/120 |
| 4,589,952 | 5/1986 | Behringer et al. | 156/628 |
| 4,639,748 | 1/1987 | Drake et al. | 346/140 R |
| 4,864,329 | 9/1989 | Kneezel et al. | 346/140 R |

*Primary Examiner*—Joseph W. Hartary

*Attorney, Agent, or Firm*—Robert A. Chittun

[57] ABSTRACT

An ink jet printhead having an integral membrane filter fabricated over the surface of the printhead containing the ink inlet is disclosed. The individual printheads are obtained by a sectioning operation which cuts aligned and bonded channel and heater wafers. The mated wafers contain a plurality of printheads and must be separated. The integral membrane filter is formed on the channel wafer after it is anisotropically etched incorporating the etch resistant mask layer and prior to mating with the heater wafer. A patternable layer is deposited over the etch resistant masking layer and exposed, patterned and developed to establish the mesh filter. In one embodiment, the side of the channel wafer not patterned and etched is heavily doped to form an etch stop which increases the robustness of the membrane filter by ensuring that the masking layer remains intact during subsequent fabricating steps. This doped region beneath the patternable layer is then etched using the membrane filter as a mask to open the filter pores through the doped layer of the channel wafer, thereby increasing the filter thickness and its overall strength.

25 Claims, 6 Drawing Sheets

INK JET PRINTHEAD HAVING INTEGRAL FILTER

BACKGROUND THE INVENTION

1. Field of the Invention

This invention relates to drop-on-demand ink jet printheads and more particularly, to a thermal ink jet printhead having an integral membrane filter over its ink inlet and process for fabricating the printhead with such filter.

2. Description of the Prior Art

A typical thermally actuated drop-on-demand ink jet printing system uses thermal energy pulses to produce vapor bubbles in an ink-filled channel that expels droplets from the channel orifices of the printing system's printhead. Such printheads have one or more ink-filled channels communicating at one end with a relatively small ink supply chamber and having an orifice at the opposite end, also referred to as the nozzle. A thermal energy generator, usually a resistor, is located in the channels near the nozzle at a predetermined distance upstream therefrom. The resistors are individually addressed with a current pulse to momentarily vaporize the ink and form a bubble which expels an ink droplet. A meniscus is formed at each nozzle under a slight negative pressure to prevent ink from weeping therefrom.

U.S. Pat. No. 4,589,952 to Behringer et al discloses a method of making trenches having substantially vertical sidewalls in a silicon substrate using a three-level mask comprising a thick photoresist layer, a silicon nitrite layer, and a thin photoresist layer. Openings are formed in the thin photoresist layer and silicon nitrite layer by reactive ion etching in $CF_4$. The openings are continued through the thick photoresist by etching in an atmosphere containing oxygen. The exposed surface of the silicon substrate is then etched in a $CF_4$ atmosphere containing a low concentration of fluorine. Also disclosed is a method of making an electron beam transmissive mask wherein the openings are made using a three level mask and reactive ion etching of silicon using the etching technique of this invention.

U.S. Pat. No. 4,419,182 to Westerberg et al discloses a method of fabricating screen lenses and aperture array plates wherein a round, flat polish 100 silicon wafer is oxidized and exposed to a pattern photolithographically. The silicon wafer is then indiffused with boron and isotropically etched to produce the predetermined pattern of holes comprising a filter.

U.S. Pat. No. 4,561,789 to Saito discloses a thermal ink transfer printing system containing a thermal printing head comprised of a porous glass substrate which is covered with a polyimide thin film and consequently photoetched to produce a pattern of holes comprising an ink filter.

U.S. Pat. No. 4,417,946 to Bohlen et al discloses a mask for structuring surface areas and a method of manufacture of such mask. The mask includes at least one metal layer with apertures which define the mask pattern and a semiconductive substrate for carrying the metal layer. A semiconductor substrate has through holes that correspond to the mask pattern. The through holes in the semiconductor substrate extend from the metal covered surface on the front to at least one tub shaped recess which extends from the other back surface into the semiconductor substrate. Holes are provided in a surface layer in the semiconductor substrate.

The surface layer differs in its doping from the rest of the substrate and the holes which are provided in the surface layer have lateral dimensions larger than the apertures in the metal layer so that the metal layer protrudes over the surface layer.

U.S. Pat. No. 4,639,748 to Drake et al discloses an ink jet printhead having an internal filtering system and fabricating process therefore. Each printhead is composed of two parts aligned and bonded together. One part contains a linear array of heating elements and addressing electrodes on one surface. The other part has a parallel array of elongated recesses for use as ink channels and a common ink supplying manifold recess in communication with the ink channels. The manifold recess contains an integral closed wall defining a chamber with an ink-fill hole. Small passageways are formed in the internal chamber walls to permit passage of ink therefrom into the manifold. Each of the passageways have smaller cross-sectional flow areas than the nozzles to filter the ink, while the total cross-sectional flow area of the passageways is larger than the total cross-sectional flow areas of the nozzles.

U.S. Pat. No. 4,864,329 to Kneezel et al discloses a thermal ink jet printhead having a flat filter placed over the inlet thereof by a fabrication process which laminates a wafer size filter to the aligned and bonded wafers containing a plurality of printheads. The individual printheads are obtained by a sectioning operation, which cuts through the two or more bonded wafers and the filter. The filter may be a woven mesh screen or preferably an electroformed screen with predetermined pore size. Since the filter covers one entire side of the printhead, a relatively large contact area prevents delamination and enables convenient leak-free sealing.

One problem associated with thermal ink jet technology is the sensitivity of ink droplet directionality to particulates in the ink. Print quality is directly related to accurate placement of the ink droplets on a recording medium and droplet directionality determines the accuracy of the ink droplet placement. It has been demonstrated that higher print quality is achieved with particulate-free ink sources and the degree of particulate-free ink is related to how close the final filtration of the ink is to the ink jet printhead. One source of particulate contamination is the manufacturing environment itself. At least a partial solution to particulate-induced misdirectionality problems is to construct the entire transducer structure in a clean environment. However, complete particle-free environments are not practical. This invention solves the problems of particle contamination during the fabrication of an ink jet printhead.

SUMMARY OF THE INVENTION

It is object of the present invention to provide an ink jet printhead having an ink supply inlet covered by an integral membrane filter and method of fabrication therefor.

It is another object of the invention to provide an integral membrane filter over the inlet of the printhead by laminating a layer of photopatternable material over an etch-resistant mask layer on the bottom or reverse of a previously completed channel plate wafer and photoprocessing these layers to form the filter.

In the present invention, a plurality of ink jet printheads with integral membrane filters are fabricated from two (100) silicon wafers. A plurality of sets of heating elements and their individually addressing electrodes are formed on the surface of one of the wafers and a corresponding plurality of sets of parallel channel grooves, each channel groove set communicating with a recessed manifold, are formed in a surface of the other wafer. The two wafers are aligned and bonded together and individual printheads are obtained by a sectioning operation which cuts the mated wafers into a plurality of printheads. The integral membrane filter is formed on the channel wafer after it is anisotroically etched and prior to mating with the heater plate wafer. A photopatternable layer is deposited over the etch resistant masking layer and exposed, patterned and developed to establish the mesh filter.

In another embodiment, a side of the channel wafer not patterned and etched is heavily doped to increase the robustness of the membrane filter by functioning as an etch stop. This doped region beneath the patternable layer is then etched using the membrane filter as a mask to open the filter pores through the doped layer portion of the channel wafer.

In addition to filtering contamination from the ink and ink supply system during printing, the membrane filter also keeps dirt and other contamination from entering the large ink inlets during printhead assembly. The foregoing features and objects will become apparent from a reading of the following specification in conjunction with the drawings, wherein like parts have the same index numerals.

DESCRIPTION OF THE PREFERRED EMBODIMENT

Figure 1:
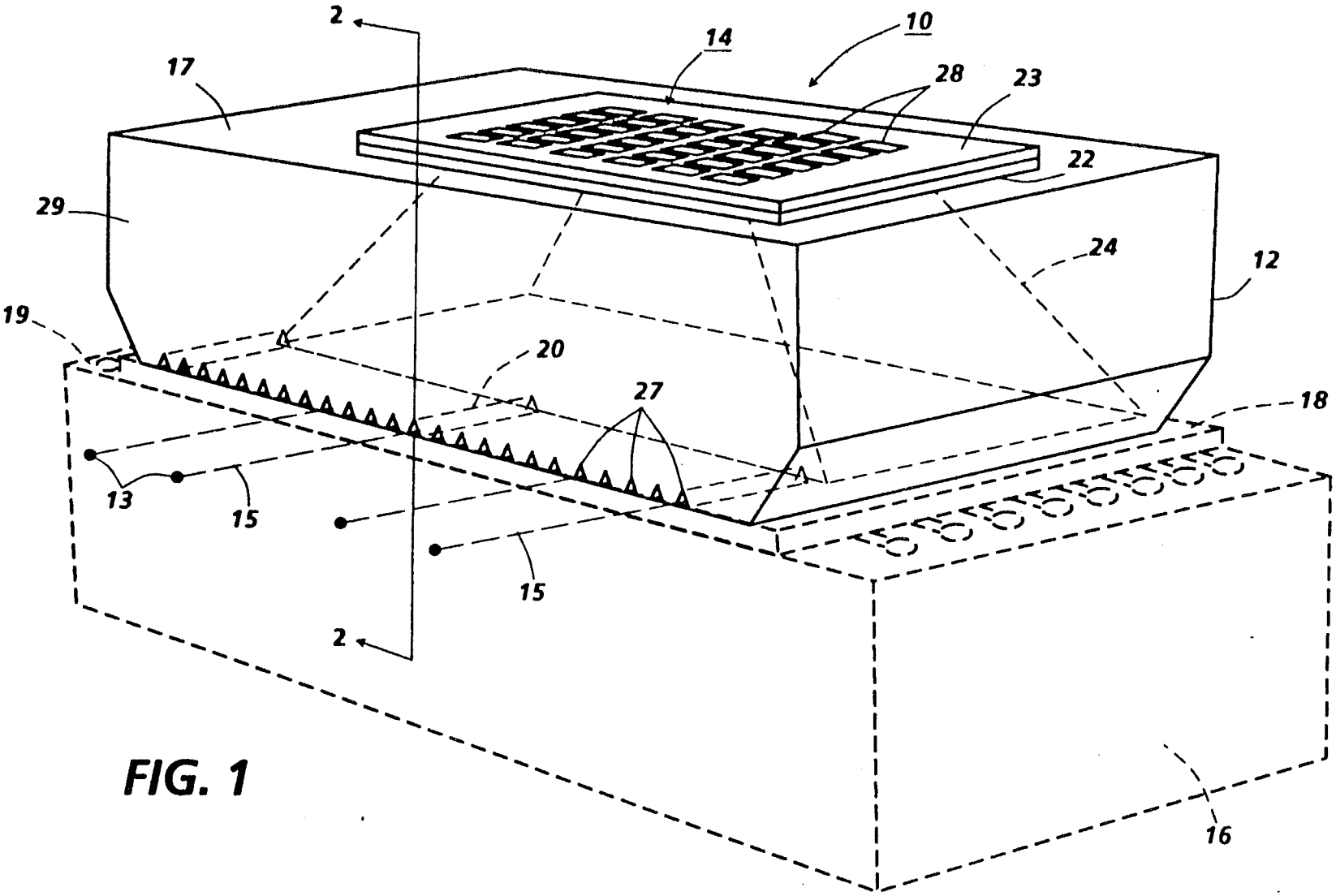
FIG. 1 is a partially shown enlarged isometric view of a single printhead having the integral membrane filter of the present invention and showing the ink droplet emitting nozzles.
Figure 2:
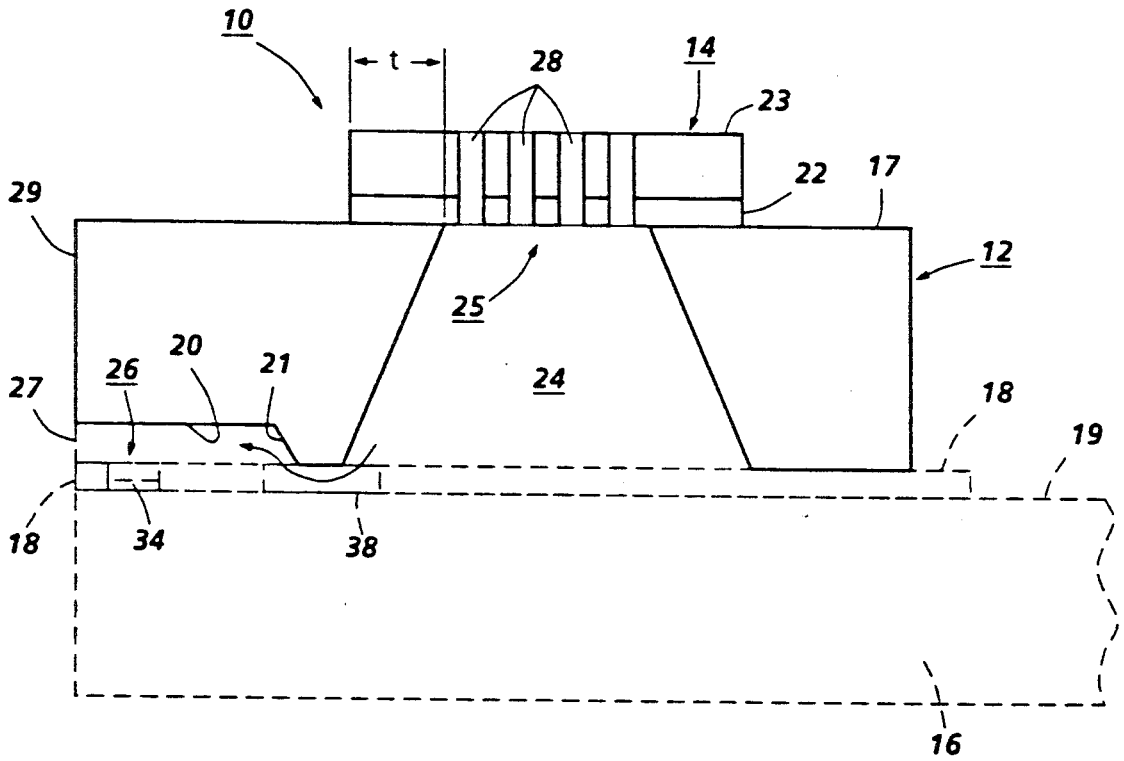
FIG. 2 is a cross-sectional view of the printhead as viewed along view line 2—2 of FIG. 1.

In FIGS. 1 and 2, a thermal ink jet printhead 10 of the present invention is shown comprising channel plate 12 with integral membrane filter 14 and heater plate 16 shown in dashed line. A patterned film layer 18 is shown in dashed line having a material such as, for example, Riston®, Vacrel®, or polyimide, and is sandwiched between the channel plate and the heater plate. As disclosed in U.S. Pat. No. 4,774,530 to Hawkins and incorporated herein by reference in its entirety, the thick film layer is etched to remove material above each heating element 34, thus placing them in pits 26, and to remove material between the closed ends 21 of ink channels 20 and the manifold 24 forming trench 38 in order to place the channels into fluid communication with the manifold. For illustration purposes, droplets 13 are shown following trajectories 15 after ejection from the nozzles 27 in front face 29 of the printhead.

Referring to FIG. 1, the printhead comprises a channel plate 12 that is permanently bonded to heater plate 16 or to the patterned thick film layer 18 optionally deposited over the heating elements and addressing electrodes on the top surface 19 of the heater plate and patterned as taught in the above-mentioned U.S. Pat. No. 4,774,530. The channel plate is silicon and the heater plate may be any insulative or semiconductive material as disclosed in the U.S. Pat. No. Re. 32,572 to Hawkins et al. The present invention is described for an edge-shooter type printhead, but could readily be used for a roofshooter configured printhead (not shown) as disclosed in U.S. Pat. No. 4,864,329 to Kneezel et al, wherein the ink inlet is in the heater plate, so that the integral filter of the present invention could be fabricated in an identical manner thereover. The description of FIGS. 8 and 9 of U.S. Pat. No. 4,864,329 is herein incorporated by reference.

Channel plate 12 of FIG. 1 contains an etched recess 24, shown in dashed line, in one surface which, when mated to the heater plate 16, forms an ink reservoir or manifold. A plurality of identical parallel grooves 20, shown in dashed line and having triangular cross sections, are etched in the same surface of the channel plate with one of the ends thereof penetrating the front face 29 thereof. The other closed ends 21 (FIG. 2) of the grooves are adjacent the recess 24. When the channel plate and heater plate are mated, the groove penetrations through edge 29 produce the orifices or nozzles 27 and the grooves 20 serve as ink channels which connect the manifold with the nozzles. The open bottom 25 of the manifold in the channel plate, shown in FIG. 2, provides means for maintaining a supply of ink in the manifold from an ink supply source (not shown). Filter 14 of the present invention has been fabricated, as discussed later, by depositing a photopatternable layer 23 over the etch resistant mask layer 22 and photodelineating a pattern of apertures or pores 28 having predetermined sizes in the range of 5-30 μm in length, width, or diameter through the two layers in an area equal to and in alignment with the open bottom 25 of the manifold 24. The layers 22, 23 may cover the entire upper surface 17 of the channel plate or may be etch removed to an area slightly larger than the manifold open bottom which serves as the ink inlet, as shown in FIGS. 1 and 2. The filter size must be large enough to provide an adequate seal around the manifold open end 25 with enough adhering surface area to prevent delamination. Referring to FIG. 2, the distance "t" represents the minimum dimension between the outer periphery of the filter 14 and the internal dimensions of the open end 25; the distance t is preferably about 25 to 50 μm.

The fluid resistance is very low because the filter is extremely thin and can be made with relatively high fluid transmission values. For example, a 4 micron thick filter in a 1,000 line per inch square grid pattern with an 18 micron square pore size, which is suitable for the present invention, has a transmission value of 50%. Other pore shapes and filter thicknesses are acceptable, so long as the pore area is about 300 square microns and the filter thickness is within 3 to 10 μm.

In addition to filtering out contamination from the ink and ink supply system during printing, the filter also keeps dirt and other debris from entering the relatively large inlets during printhead assembly. In this way, it is possible to use less strigently clean and, therefore, less expensive assembly rooms for printhead manufacture, after the filter has been bonded in place. Operations up through assembly of the filter onto the bonded channel and heater wafers will need to occur in a clean room or under a clean hood, while subsequent operations can compromise somewhat on cleanliness.

Figure 3A:
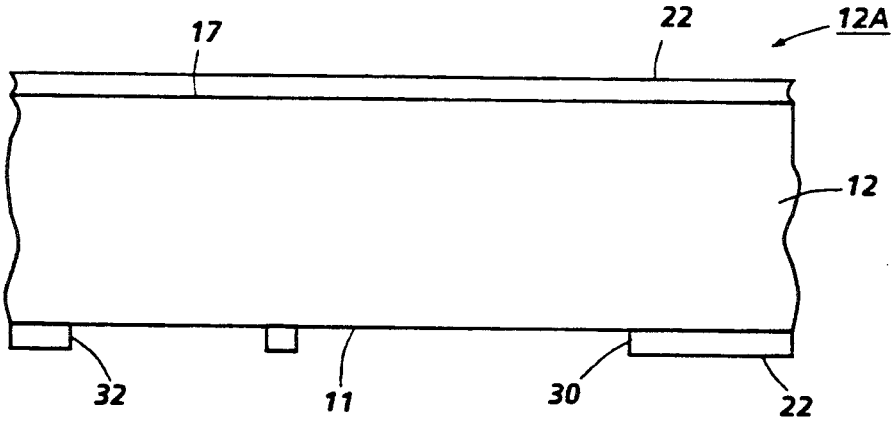
FIG. 3A-3F show partial cross-sectional views of the channel plate fabricating steps which include the fabrication of the integral membrane filter.
Figure 3B:
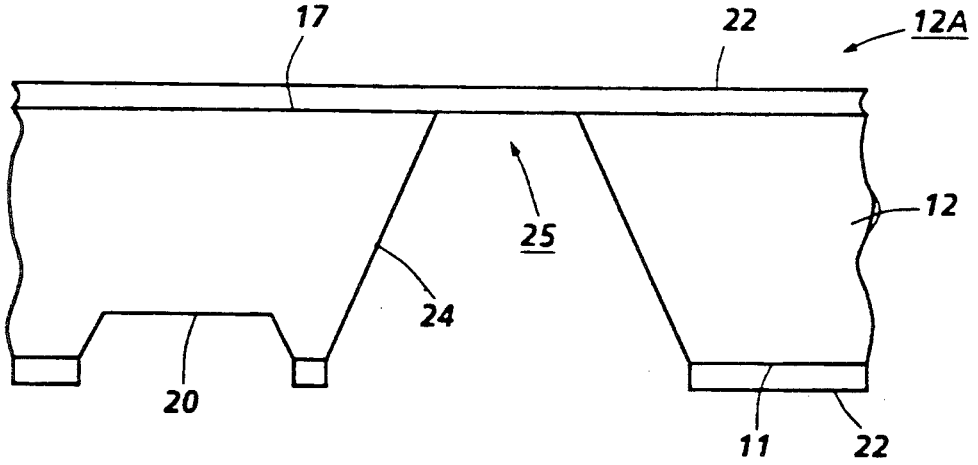

The fabricating process for the channel plate having an integral membrane filter over its ink inlet is shown in FIGS. 3A-3F, each being partial, cross-sectional views of a (100) silicon wafer 12A and showing substantially only one of a plurality of channel plates 12. After the wafer is chemically cleaned, an etch resistant mask layer such as a pyrolytic CVD silicon nitride layer 22 is deposited to a thickness of about 1,000 Å on both top and bottom sides, 17 and 11 respectively. In FIG. 3A, the silicon nitride layer 22 on the bottom side 11 of the wafer (and channel plate) is photolithographically patterned to form a relatively large rectangular via 30 and a set of elongated, parallel vias 32. As disclosed in the above-mentioned reissue patent to Hawkins and shown in FIG. 3B, a potassium hydroxide (KOH) anisotropical etchant is used to etch the bottom surface 11 of the wafer 12A and form the channel grooves 20 and manifold recess 24. The manifold recess is etched through the wafer to provide an open bottom 25 that is closed by the etch resistant mask or silicon nitride layer 22 on the top surface 17 of the wafer.

Figure 3C:
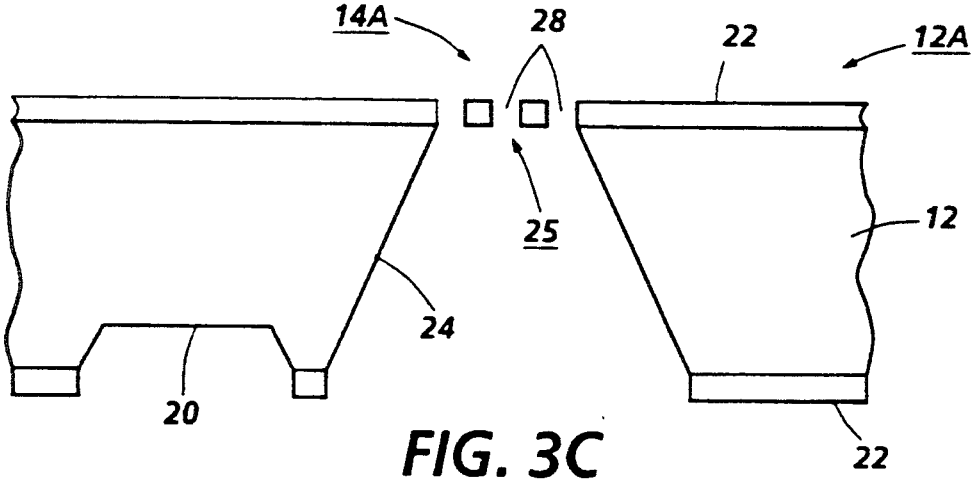

It can be seen from FIG. 3C that the silicon nitride layer 22 covering the open bottom 25 of the manifold recess 24 could be photolithographically patterned and plasma etched to produce pores 28 and thus provide an integral filter 14A. However, this pyrolytic nitride membrane filter is very thin and highly stressed, so that is tends to be too fragile for use in a commercial ink jet printer.

Figure 3D:
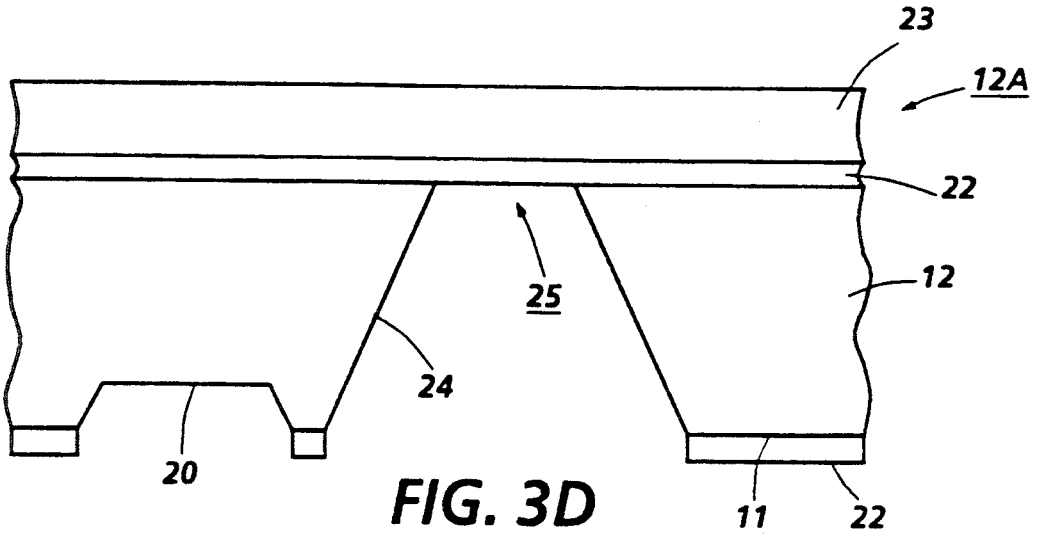
Figure 3E:
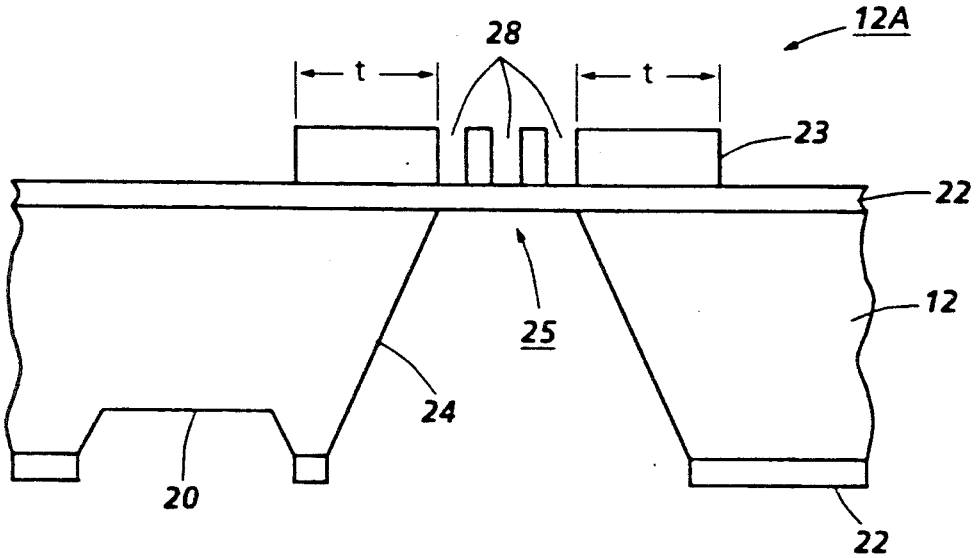
Figure 3F:
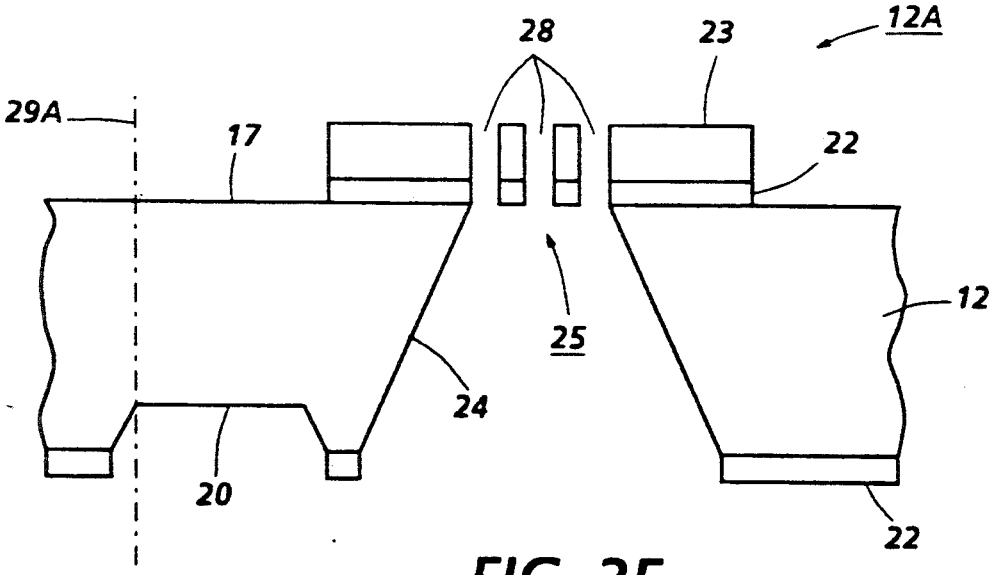

To ensure the strength of the membrane filter, the preferred embodiment of the filter is produced by depositing a much thicker film of plasma enhance CVD nitride 23 over the pyrolytic silicon nitride layer 22, as shown in FIG. 3D. The plasma enhanced nitride layer is deposited to a thickness of about 15,000 Å, and, since it is more than an order of magnitude thicker than the pyrolytic silicon nitride layer, it can be deposited with very low or negligible stress, and therefore provides for a much stronger membrane from which the filter pores 28 can be photolithographically fabricated to produce the integral filter 14, as shown in FIGS. 3E and 3F. In FIG. 3E, the plasma enhanced silicon nitride layer 23 is shown photolithographically patterned to produce the pores 28 therein as well as reduce the size to one whose outer periphery that surrounds the pores 28 is 2t dimensionally larger than the manifold inlet (open bottom) 25. Using the patterned plasma enhance silicon nitride as a mask the membrane filter is completed as shown in FIG. 3F. Dashed line 29A represents the cutting lines for separating the printheads after alignment and bonding of heater plate and channel plate wafers together, so that the channels 20 are opened to form nozzles 27.

In one alternate embodiment (not shown), the plasma enhanced silicon nitride layer is replaced by laminating a layer of Vacrel® having a thickness of 2 to 4 μm on the pyrolytic silicon nitride layer on the top surface 17 of the wafer 12A, and then photoprocessing the two layers to form the integral membrane filter. Prior to laminating the Vacrel® layer on the pyrolytic silicon nitride layer, a thin coat of epoxy may be applied to improve its adhesion to the Vacrel®. As in the preferred embodiment, the filter pattern can be over the entire wafer surface or only over the ink inlet and surrounding edge which is large enough to provide a good seal and bonding area to prevent delamination. After curing, the channel wafer with integral filters is ready to be aligned and bonded to the heater wafer and then diced into individual printheads 10.

Figure 4A:
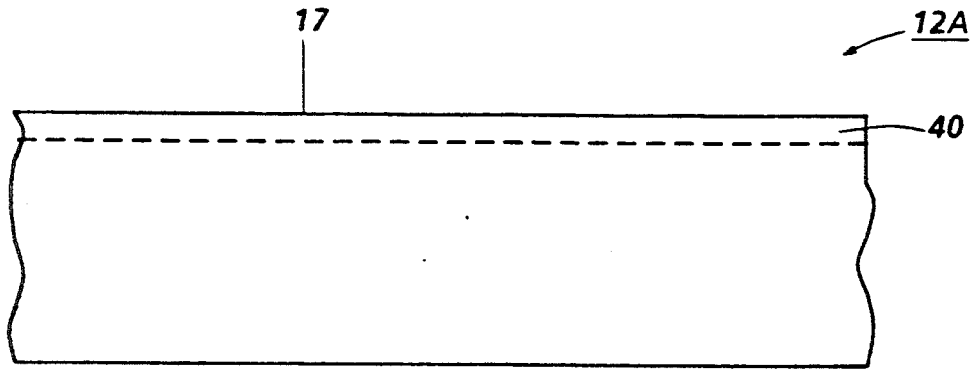
FIGS. 4A-4E show partial cross-sectional views of the channel plate fabricating steps of an alternate embodiment of the present invention.
Figure 4B:
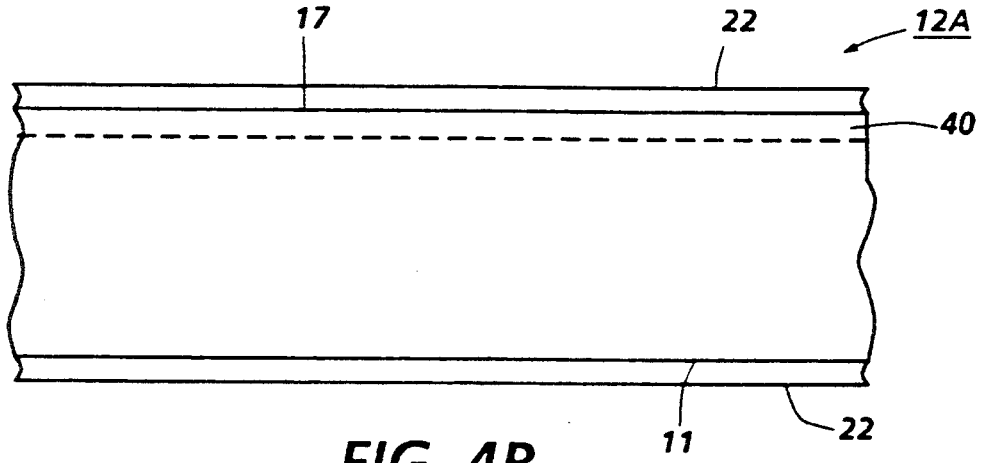
Figure 4C:
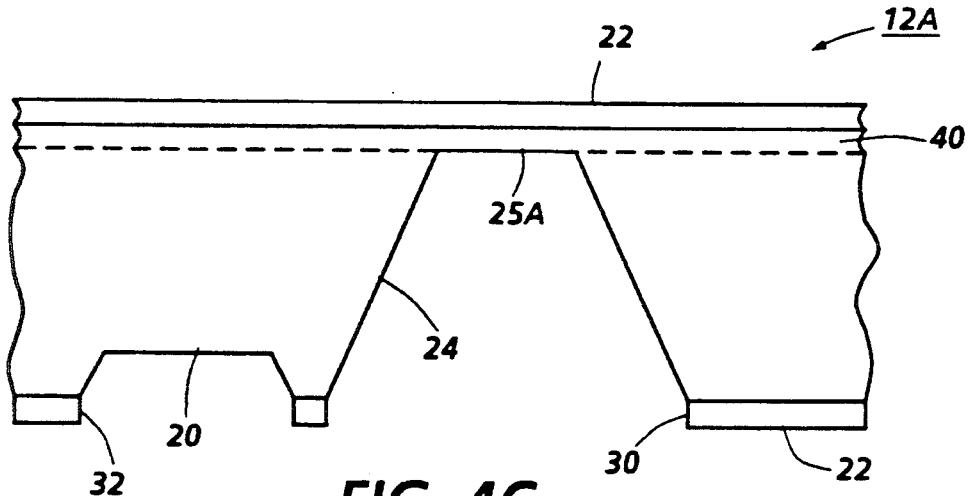
Figure 4D:
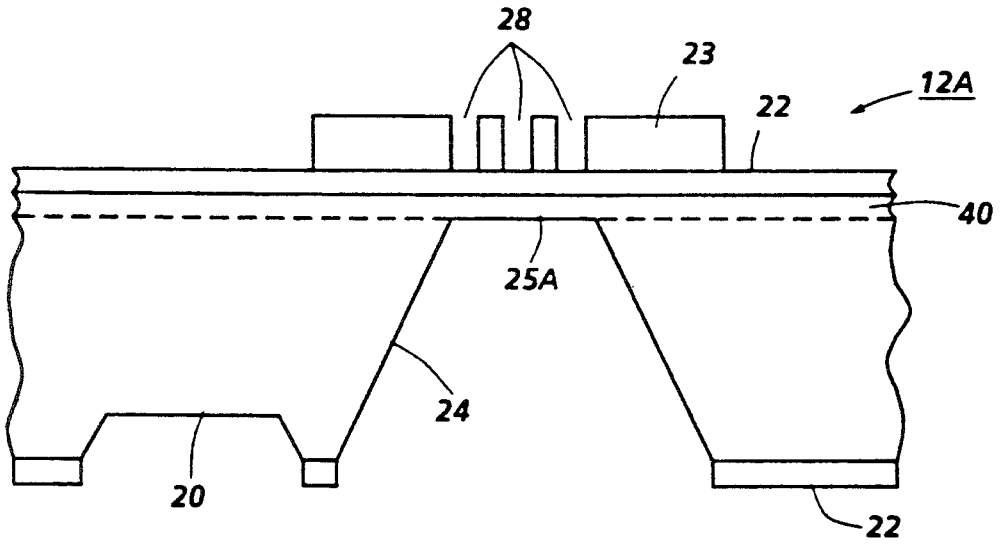
Figure 4E:
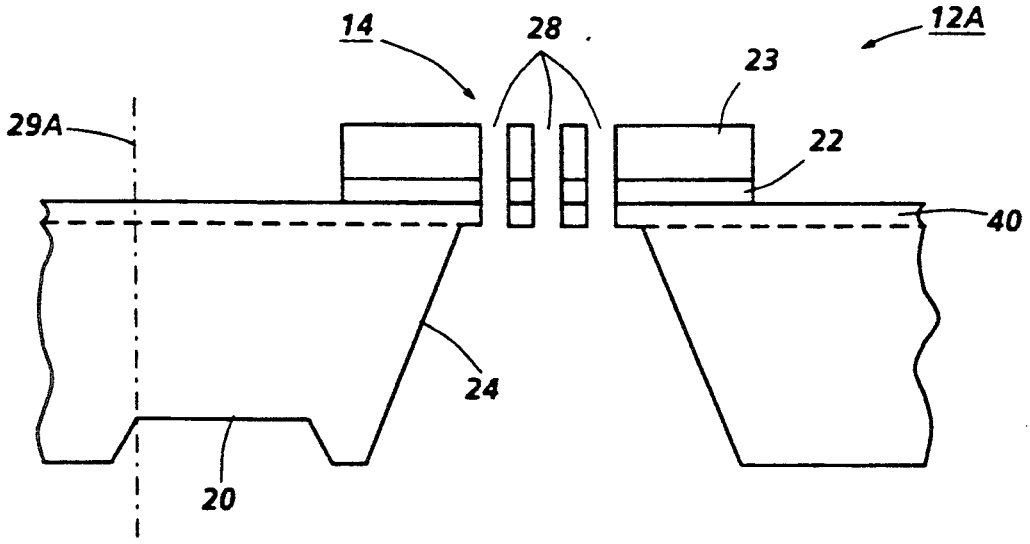

Another embodiment of the integral membrane filter and fabricating process therefor is shown in FIGS. 4A through 4E. To successfully apply the strengthening, substantially stress-free photopatternable layer 23, for example, plasma enhanced silicon nitride or polyimide, the pyrolytic silicon nitride layer must remain intact over the manifold open bottom (ink inlet). To ensure the highly stressed pyrolytic silicon nitride layer 22 remains intact and to add more strength and robustness to the membrane filter the top surface 17 of the silicon wafer 12A, the wafer surface is heavily doped with, for example, boron. The dopant may be applied by ion implantation or by using a spin on dopant and drive diffusion to form a doped layer 40 having a depth of about 2 to 10 μm, as shown in FIG. 4A in dashed line. In FIG. 4B, a pyrolytic silicon nitride layer 22 is deposited on both top and bottom surfaces 17, 11 of the wafer 12A, respectively, in the same manner as described above in FIG. 3A. The bottom silicon nitride layer is photolithographically patterned to produce a plurality of sets of parallel elongated vias 32 and associated manifold producing vias 30, followed by anisotropically etching the exposed wafer surfaces through the vias to produce the channel grooves 20 and manifold recess 24 as shown in FIG. 4C. The doped layer 40 of the silicon wafer acts as an etch stop and produces a manifold recess bottom 25A. The integral membrane filter is formed in FIGS. 4D and 4E by first depositing a patternable layer 23 such as plasma enhanced silicon nitride or polyimide and photolithographically forming pores 28, therein over and in alignment with the manifold bottom 25A, followed by etching of the prolytic silicon nitride layer 22, using the pores in layer 23 as a mask, and then plasma etching of the pores through the doped layer 40 in the silicon wafer 12A using the patterned pores in the patternable layer 23 and silicon nitride layer 22 as a mask. Dashed line 29A in FIG. 4E shows the dicing line to produce the printhead front face 29 and open the channel grooves to form the nozzles 27 after the channel wafer 12A is aligned and bonded to the heater wafer (not shown)

Many mofifications and variations are apparent from the foregoing description of the invention and all such modifications and variations are intended to be within the scope of the present invention.

I claim:

1. An ink jet printhead having an ink supply inlet covered by an integral membrane filter to prevent contaminates entrained in the ink from entering the printhead, comprising:

first and second substrates, each having two opposing surfaces;

one surface of the first substrate containing a linear array of heating elements and associated addressing electrodes;

one surface of the second substrate containing a manifold recess having a bottom at a predetermined depth and a parallel set of elongated grooves open at one end through an edge of the second substrate and the other ends being in communication with the common manifold recess, the manifold recess and grooves being etched through a patterned etch resistance mask layer while the other surface of the second substrate remains protected by an unpatterned etch resistant mask layer;

a second patternable layer being deposited over the unpatterned etch resistant mask on the second substrate, the second patternable layer and underlying etch resistant mask layer being patterned to establish a multi-layered mesh filter having a predetermined pore size in alignment with bottom of the manifold recess prior to mating of the first and second substrates, so that the mesh filter provides a filtered inlet to the manifold recess;

the surface of the first substrate having the heating elements and addressing electrodes being aligned with and bonded against the surface of the second substrate having the manifold recess and set of grooves, so that each groove has one of the heating elements therein spaced a predetermined distance from the groove open ends that serve as droplet emitting nozzles;

means for providing ink at a predetermined pressure to the filter covered inlet, so that ink travels through the filter covered inlet and is filtered thereby as it flows first into the manifold, then into the grooves, which serves as capillary channels, to form a meniscus at each nozzle; and means for selectively applying electrical pulses to the heating elements via the addressing electrodes to produce momentary vapor bubbles in the ink which contacts the heating elements which eject ink droplets from the nozzles.

2. The printhead of claim 1, wherein the predetermined manifold recess depth is equal to the second substrate thickness, providing an open manifold recess bottom exposing the unpatterned etch resistant mask layer; and wherein the patterned filter in the second patternable layer is used as a mask to etch the underlying etch resistant mask layer providing the multi-layered integral membrane filter over the inlet to the manifold.

3. The printhead of claim 2, wherein the etch resistant mask layer is pyrolytic silicon nitride.

4. The printhead of claim 3, wherein the second patternable layer is plasma enhanced silicon nitride.

5. The printhead of claim 3, wherein the second patternable layer is Vacrel® having a thickness of about 2 to 4 μm.

6. The printhead of claim 4, wherein the pyrolytic silicon nitride layer has a thickness of about 1,000 Å; and wherein the plasma enhanced silicon nitride layer has a thickness of about 15,000 Å.

7. The printhead of claim 6, wherein the first and second substrates sandwich a patterned thick film layer having a plurality of recesses which places the heating elements in a pit to enable higher frequency of droplet ejection and high droplet velocity and having an elongated slot which provides the means of communication between the channel grooves and the manifold recess.

8. The printhead of claim 1, wherein the predetermined manifold recess depth provides a manifold bottom at a depth of less than the second substrate thickness; and wherein the second substrate material between the filter patterned etch resistant mask layer and the bottom of the manifold recess is etched using the mesh filter as a mask to form pores therethrough, so that the mesh filter is comprised of three layers and thereby more robust.

9. The printhead of claim 8, wherein the second substrate material between the filter patterned etch resistant mark layer and the manifold recess bottom is doped prior to deposition of the etch resistant mask layer to form an etch stop layer.

10. The printhead of claim 9, wherein the etch resistant mask layer is pyrolytic silicon nitride and the second patternable layer is plasma enhanced silicon nitride; and wherein the etch stop layer has a thickness of 2 to 4 μm, so that the pyrolytic silicon nitride layer is supported by the etch stop layer after etching of the manifold recess and maintains the pyrolytic silicon nitride layer intact prior to and during deposition of the thicker plasma enhanced silicon nitride layer.

11. A method of fabricating an ink jet printhead for use in an ink jet printer having an integral filter comprising the steps of:

(a) depositing an etch resistant mask layer on the top and bottom surfaces of a (100) silicon wafer;

(b) applying and patterning a photoresist layer on the top surface of the silicon wafer to produce a pattern of vias therein suitable for subsequent production of vias in the mask layer that will enable the etching of the set of parallel grooves and associated manifold recess having a predetermined depth;

(c) forming a pattern of vias in the mask layer on the top surface of the wafer through the pattern of vias in the photoresist layer;

(d) removing the photoresist layer;

(e) anisotropically etching the top surface of the silicon wafer to form a set os parallel grooves and a recess having a bottom at a predetermined depth for subsequent use as an ink manifold, the bottom of the manifold recess confronting the mask layer deposited on the bottom surface of the wafer and being subsequently used to form an inlet to supply ink to the manifold;

(f) depositing a photopatternable layer over the mask layer on the bottom surface of the wafer;

(g) patterning and etching a plurality of equally sized and spaced pores having a predetermined pore size in the photopatternable layer only in the area of the confronting bottom of the recess and then etching the underlaying mask layer using the photopatternable layer with the etched pores as a mask to produce a multi-layered integral mesh filter aligned with and having an area substantially equal to the bottom of the manifold recess;

(h) forming a linear array of heating elements and addressing electrodes on the top surface of an insulative planar substrate for enabling the individual, selective application of electrical pulses to the heating elements;

(i) aligning and bonding the top surface of the silicon wafer having the channel grooves and manifold recess with the top surface of the planar substrate, so that each groove forms an ink channel and contains a heating element therein, the integral filter preventing entry of contaminating particles larger than the filter pore into the manifold during subsequent fabrication steps and installation into an ink printer; and (j) dicing the mated wafer and substrate into a plurality of individual printheads, one of the dicing cuts being along planes perpendicular to the channels and a predetermined distance downstream from the heating elements to produce channel open ends that will serve as nozzles, ink supplied to the printhead manifold being filtered by the integral filter prior to entry therein.

12. The method of claim 11, wherein the etching of the manifold recess during step (e) is a through etch providing an open bottom to the manifold recess exposing the mask layer on the bottom surface of the wafer, whereby the predetermined depth of the recess is equal to the thickness of the silicon wafer.

13. The fabrication method of claim 11, wherein the method further comprises the step of:

(k) prior to depositing the etch resistant mask layer on the bottom surface of the silicon wafer at step (a), heavily doping the bottom surface of the silicon wafer and driving the dopant to a predetermined depth to provide an etchant stop and prevent step (e) from etching the manifold recess through the etchant stop, thereby spacing the recess bottom from the mask layer; and (l) after step (g), etching the doped silicon bottom using the patterned pores in the photopatternable layer and underlying etch resistant mask layer as a mask to produce a three layered integral filter which is more robust.

14. The fabrication method of claim 11, wherein the method further comprises the step of:

(m) after step (h), depositing and patterning a thick film layer over the heating elements and addressing electrodes, the thick film layer being removed over the heating elements, so that they are in pits, and a slot is produced as a predetermined location to provide the means for communication between the channels and manifold at the conclusion of step (i).

15. An improved ink jet printhead of the type having an ink supply inlet, a plurality of selectively addressable heating elements for momentarily vaporing ink in contact therewith to form droplet ejecting bubbles, and a droplet emitting nozzle for each heating element, the printhead ejecting and propelling droplets on demand to a recording medium in response to digitized data signals, wherein the improvement comprises:

A silicon substrate having opposing parallel surfaces and containing an etched inlet therethrough, the inlet being etched through at least one via patterned on one side of an etch resistant mask layer which is deposited on both substrate surfaces, so that the etched inlet has an open bottom; and a multi-layered membrane filter covering the inlet, the filter being formed by depositing a second patternable layer over the etch resistant mask layer and sequentially patterning the second patternable layer and then the etch resistant mask layer to from an array of through-holes or pores in alignment with the inlet open bottom to produce the membrane filter, so that the filter is concurrently fabricated with the printhead and prevents contaminating particles from entering the printhead during the remainder of the fabricating process and subsequent installation in an ink jet printer.

16. An ink jet printhead having an ink supply inlet covered by an integral membrane filter to prevent contaminates entrained in the ink form entering the printhead, comprising:

first and second mated substrates, each substrates having two opposing surfaces;

one surface of the first substrate containing a linear array of heating elements and associated addressing electrodes;

one surface of the second substrate containing a manifold recess having a bottom at a predetermined depth and a parallel set of elongated grooves open at one end through an edge of the second substrate and the other ends being adjacent and in communication with the common manifold recess, and the other surface of the second substrate being covered by first etch resistant mask layer and an overlying second etch resistant mask layer, both containing a pattern of aligned and identical openings therethrough, with each opening having a predetermined pore size, the pattern of openings being in alignment with bottom of the manifold recess to form a multi-layered mesh filter, so that the mesh filter provides a filtered inlet to the manifold recess;

the surface of the first substrate having the heating elements and addressing electrodes being in alignment with and bonded against the surface of the second substrate having the manifold recess and set of grooves, so that each groove has one of the heating elements therein spaced a predetermined distance from the groove open ends that serve as droplet emitting nozzles;

means for providing ink at a predetermined pressure to the filter covered inlet, so that ink travels through the filter covered inlet and is filtered thereby as it flows first into the manifold, then into the grooves, which serve as capillary channels, to form a meniscus at each nozzle; and means for selectively applying electrical pulses to the heating elements via the addressing electrodes to produce momentary vapor bubbles in the ink which contacts the heating elements which eject in droplets from the nozzles.

17. The printhead of claim 16, wherein the predetermined manifold recess depth is equal to the second substrate thickness, providing an open manifold recess bottom exposing the etch resistant mask layers.

18. The printhead of claim 17, wherein the first etch resistant mask layer is pyrolytic silicon nitride.

19. The printhead of claim 18, wherein the overlying second etch resistant mask layer is plasma enhanced silicon nitride.

20. The printhead of claim 18, wherein the overlying second etch resistant mask layer is Vacrel® having a thickness of about 2 to 4 μm.

21. The printhead of claim 19, wherein the pyrolytic silicon nitride layer has a thickness of about 1,000 Å; and wherein the plasma enhanced silicon nitride layer has a thickness of about 15,000 Å.

22. The printhead of claim 21, wherein the first and second substrates sandwich a patterned thick film layer having a plurality of recesses which places the heating elements in a pit to enable higher frequency of droplet ejection and high droplet velocity and having an elongated slot which provides the means of communication between the channel grooves and the manifold recess.

23. The printhead of claim 16, wherein the predetermined manifold recess depth provides a manifold bottom at a depth of less than the second substrate thickness; and wherein the second substrate material between the filter patterned etch resistant mask layers and the bottom of the manifold recess contains a pattern of pores therethrough having the same size and being in alignment with the openings in said first and second etch resistant mask layers so that the mesh filter is comprises of three layers and thereby more robust.

24. The printhead of claim 23, wherein the second substrate material between the filter patterned etch resistant mask layers and the manifold recess bottom is doped to form an etch stop layer.

25. The printhead of claim 24, wherein the first etch resistant mask layer is pyrolytic silicon nitride and the overlying second etch resistant mask layer is plasma enhanced silicon nitride; and wherein the etch stop layer has a thickness of 2 to 4 μm, so the pyrolytic silicon nitride layer is supported by the etch stop layer and maintains the pyrolytic silicon nitride layer intact prior to and during subsequent deposition of the thicker plasma enhanced silicon nitride layer.

* * * * *